United States Patent [19]

Hadtke

[11] Patent Number: 4,807,747

[45] Date of Patent: Feb. 28, 1989

[54] PACKAGE STRUCTURE FOR SPARK PLUGS

[75] Inventor: Frederick B. Hadtke, New Providence, N.J.

[73] Assignee: Champion Spark Plug Company, Toledo, Ohio

[21] Appl. No.: 183,698

[22] Filed: Apr. 19, 1988

Related U.S. Application Data

[63] Continuation-in-part of Ser. No. 97,383, Sep. 16, 1987, abandoned, which is a continuation of Ser. No. 850,536, Apr. 11, 1986, abandoned.

[51] Int. Cl.[4] ..... B65D 85/00

[52] U.S. Cl. ..... 206/327; 206/470; 206/471; 206/594; 206/587; 206/503

[58] Field of Search ..... 206/327, 211, 587, 470, 206/471, 594, 564, 332, 503

[56] References Cited

U.S. PATENT DOCUMENTS

| | | | |
|---|---|---|---|
| 2,816,666 | 12/1957 | Nadel | 211/13 |
| 3,351,270 | 11/1967 | Hohnjec | 229/44 |
| 3,388,827 | 6/1968 | Thanhauser et al. | 220/60 |
| 3,429,424 | 2/1969 | Dow | 206/1 |
| 3,463,309 | 8/1969 | Szostek | 206/78 |
| 3,576,271 | 4/1971 | Seeley | 220/31 |
| 3,589,552 | 6/1971 | Fitzgerald | 220/60 |
| 3,676,159 | 7/1972 | Fallowfield | 99/174 |
| 3,730,338 | 5/1973 | Chesky | 206/63.2 R |
| 3,730,739 | 5/1973 | Seiferth et al. | 99/174 |
| 3,844,409 | 10/1974 | Bodolay et al. | 206/45.34 |
| 3,923,152 | 12/1975 | Minneman | 206/3 |
| 4,013,214 | 3/1977 | Hansen et al. | 229/44 |
| 4,016,972 | 4/1977 | Szamborski | 206/471 X |
| 4,186,846 | 2/1980 | Jacalone et al. | 220/468 |
| 4,193,496 | 3/1980 | Barratt | 206/380 |
| 4,413,731 | 11/1983 | Weideman | 206/379 |
| 4,499,353 | 2/1985 | Sheilds | 206/470 |
| 4,533,065 | 8/1985 | Chazal et al. | 220/462 |
| 4,555,056 | 11/1985 | Bernhardt | 229/45 R |
| 4,566,626 | 1/1986 | Wood et al. | 229/37 R |
| 4,570,818 | 2/1986 | Borst et al. | 220/339 |
| 4,593,819 | 6/1986 | Will | 206/538 |
| 4,619,364 | 10/1986 | Czopor, Jr. | 206/470 X |
| 4,669,610 | 6/1987 | Lindsey et al. | 206/471 X |
| 4,681,223 | 7/1987 | Roberts | 206/470 X |
| 4,687,129 | 8/1987 | Cugley | 206/470 X |
| 4,724,964 | 2/1988 | Hernandez | 206/470 X |
| 4,739,883 | 4/1988 | Mohs et al. | 206/470 |
| 4,749,082 | 6/1988 | Gardiner et al. | 206/471 X |

FOREIGN PATENT DOCUMENTS

| | | | |
|---|---|---|---|
| 1460739 | 10/1966 | France | 206/327 |

OTHER PUBLICATIONS

"Blisterbox" Display Package; Placon; pp. 1-20; 1982.

*Primary Examiner*—William Price
*Attorney, Agent, or Firm*—John C. Purdue

[57] ABSTRACT

A package structure is disclosed. The structure comprises a lid and a base, both of a flexible material which is relatively reistant to elongation and compression. The lid and the base are movable relative to one another between an open position and a closed position. The lid has a central, substantially planar lid panel, and lid channel means which is integral with, and extends about a major portion of the periphery of, the lid panel. The base has a generally flat base panel, and a stepped base wall which is integral with, and extends completely around the periphery of, the base panel. When the lid and the base are in a closed position, the channel means and the step of the stepped base wall abut one another. The structure also includes a base insert adjacent the base panel, interior of said stepped wall. The insert is sufficiently stiff and extends into sufficiently close proximity with opposed portions of the base that it is operable to strengthen the base against flexing.

29 Claims, 9 Drawing Sheets

PACKAGE STRUCTURE FOR SPARK PLUGS

CROSS-REFERENCE TO RELATED APPLICATIONS

This is a continuation-in-part of application Ser. No. 097,383 filed Sept. 16, 1987, now abandoned, which application was, in turn, a continuation of application Ser. No. 850,536 filed Apr. 11, 1986, now abandoned.

FIELD OF THE INVENTION

The present invention relates in general to containers for goods and in particular to an improved package structure for spark plugs.

The packaging industry is continually developing new structures for containing and displaying various goods. Such package structures must meet several basic requirements. First, they must be strong enough that the goods are contained reliably therein during normal handling. Second, they must be relatively inexpensive so as not to increase the overall price of the goods by an undesirable amount. Third, they should preferably be formed in a shape in which the goods can be contained efficiently and which allows for convenient stacking, both for shipment and display. Fourth, they should be aesthetically pleasing to promote the sale of the enclosed goods. Finally, they should facilitate the graphic display of the goods. All of the above requirements must further take into account the size, shape, and weight of the enclosed goods.

DESCRIPTION OF THE PRIOR ART

Spark plugs have long posed unique problems to the packaging industry, mainly because of their irregular shape and relatively high density. As a result, spark plugs are typically shipped and displayed in one of two well known types of package structures. One type of package structure involves the use of an individual cardboard carton for each spark plug. A plurality of such individual spark plug cartons are typically packed within a single larger cardboard carton which then constitutes a package containing the number of spark plugs to be sold as an individual unit. Such cardboard carton packages are relatively inexpensive to manufacture and are easy to pack for shipping, but suffer in several other respects. First, the cardboard cartons are inefficient containers because the spark plug in each occupies only a small fraction of the carton and, as a consequence, is free to move therein and is subject to damage, change of the pre-set gap, or both. Further, the large volume of the carton, compared to that of the spark plug, wastes shipping and display space. Second, although such cardboard cartons are relatively inexpensive to fabricate, there is undesirable duplication because several of the cartons for the individual spark plugs are themselves contained in a larger carton for shipping and display. Lastly, such cardboard cartons are opaque and, therefore, must be opened for the spark plugs inside to be visible.

The other type of commonly used packaging for spark plugs is usually referred to as a blister card. The blister card consists of a flat, relatively stiff piece of cardboard with one or two spark plugs supported relative thereto by a "blister". If the card contains only one plug, the blister is a sheet of clear plastic thermoformed to a desired shape, and heat sealed to the cardboard with the spark plug inside. If the card contains two spark plugs, there are usually two oval apertures through the cardboard. A spark plug is received in each of the apertures, and the entire piece of cardboard is wrapped in a relatively thick transparent plastic material which is thermoformed to hold each plug and heat sealed to the cardboard. The blister card is a desirable package because the spark plugs can be seen without opening the container. However, blister cards cannot be stacked for shipping or display, cannot stand on display shelves, and are relatively difficult and expensive to manufacture. Also, the cardboard of blister cards must be large enough for the required heat sealing, and must extend between the apertures of two plug packages, requiring it to be considerably larger than the length and diameter of the plug or plugs it contains. An improved package structure for shipping and displaying spark plugs which does not suffer from the drawbacks mentioned above would, therefore, be desirable.

SUMMARY OF THE INVENTION

The present invention relates to an improved package structure for shipping and displaying spark plugs. The package structure includes a generally flat lid connected by a hinge along one end thereof to a base. The lid and the base, in one embodiment of the invention, have cooperating curved channels throughout their respective peripheries. In a closed position, the lid channel is received within the base channel, or, visa versa, the base channel is received within the lid channel, throughout the peripheries of the two, thereby securely, but releasably, retaining the lid in the closed position and increasing the overall strength of the package structure. In another embodiment, there are two opposed lid channels, one extending along one of a first pair of opposed edges of the lid panel and inwardly along the other two of the opposed edges, and the other extending along the other of the first pair of opposed edges and inwardly along the other two of the opposed edges; the base has a stepped wall which extends completely around the base panel. When the lid and the base are in a closed position, the step of the stepped wall and the lid channels abut one another. The structure also includes two upstanding opposed raised portions integral with the bottom of the base. The raised portions include recesses for receiving the opposed ends of a plurality of spark plugs to support them in alternating fashion within the base. Each of the recesses includes two opposed lip portions operable to retain the ends of the spark plugs releasably within the recesses. A cardboard insert strengthens the package structure. A bottom portion of the insert extends throughout the base between the opposed raised portions and the front and rear ends. The insert also has end portions which extend upwardly along the front and rear ends of the package structure and a top portion which extends throughout the lid. The sides of the base are tapered slightly inwardly from top to bottom, and a plurality of feet may be formed on either or both of the sides of the package structure extending outwardly therefrom so that the package structure is capable of standing upwardly on one or both sides. The entire package structure can be vacuum thermoformed from a single piece of transparent industrial grade polyvinylchloride material.

It is an object of the present invention to provide an improved package structure for spark plugs.

It is another object of the present invention to provide such an improved package structure which is capable of easy and efficient stacking and handling, and in which the spark plugs can be stored easily and efficiently.

It is a further object of the present invention to provides such an improved package structure which is aesthetically pleasing and through which the spark plugs it contains can be viewed without opening thereof.

Other objects and advantages of the present invention will become apparent to those skilled in the art from the following detailed description of the preferred embodiments, reference being made to the accompanying drawings.

DESCRIPTION OF THE PREFERRED EMBODIMENTS

Figure 1:
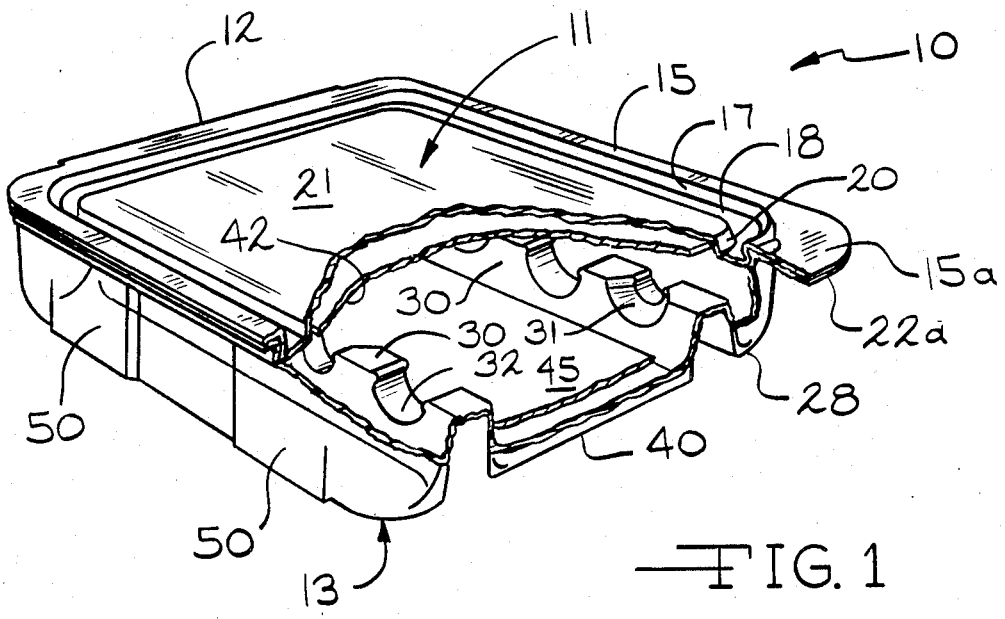
FIG. 1 is a perspective view, partially broken away, of an improved package structure in accordance with the present invention, the lid being shown in a closed position.

Referring now to the drawings, an improved package structure according to the present invention is indicated generally at 10 in FIGS. 1-9. Although the package structure 10 shown in the drawings is described as a container for spark plugs, it will be appreciated that the package of the present invention can be utilized to contain other types of goods. The package structure 10 is generally right rectangular parallelepipedal in shape. As will become apparent below, the package structure 10 can be integrally formed from a single piece of material. Preferably, the material is a lightweight, transparent synthetic resinous material, such as industrial grade clear polyvinylchloride; its thickness usually ranges from 0.018 inch to 0.024 inch. Other materials can be utilized, and the various portions of the package structure can be formed as separate pieces. In any event, the material utilized should be flexible, Yet relatively resistant to elongation and compression. in order to achieve several of the advantages of the present invention described below.

Figure 2:
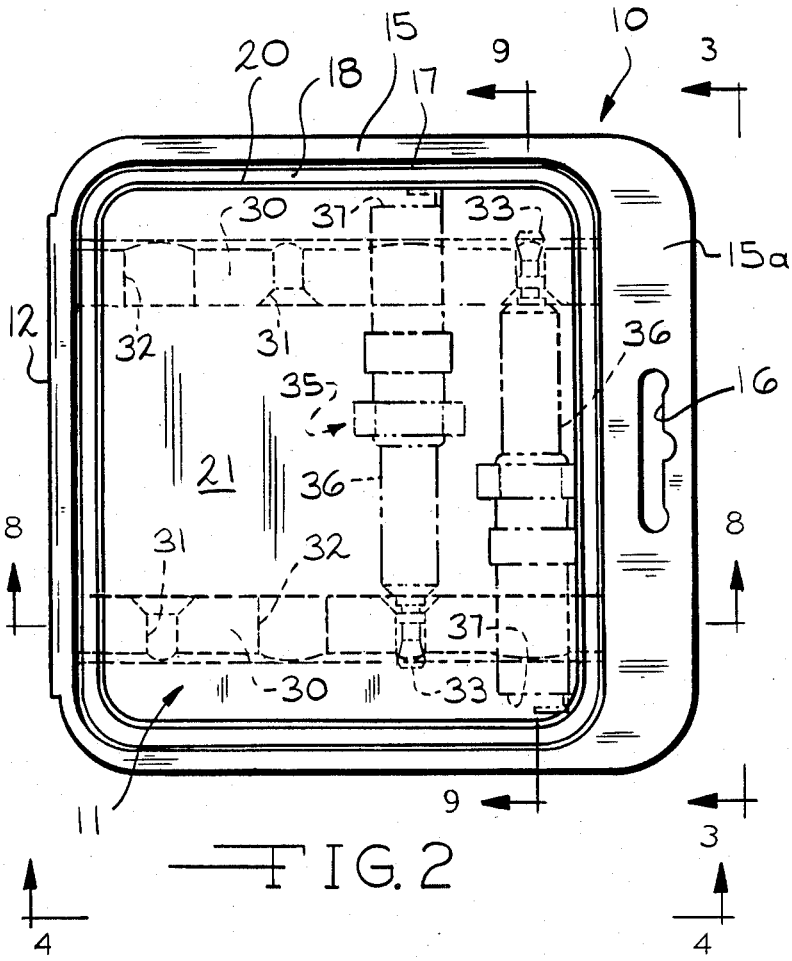
FIG. 2 is a top plan view of the package structure of FIG. 1.
Figure 8:
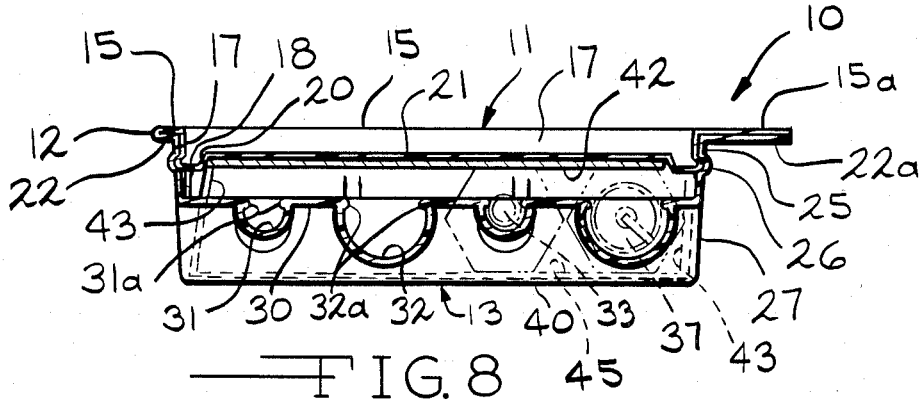
FIG. 8 is a view in vertical section taken along the line 8—8 of FIG. 2.
Figure 9:
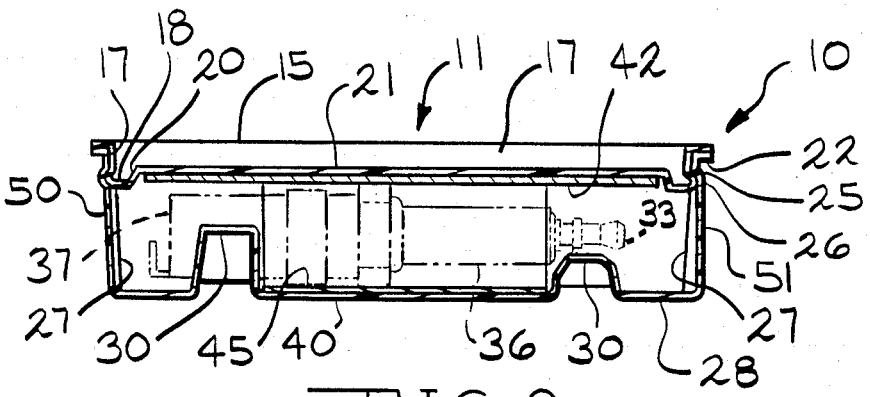
FIG. 9 is a vertical sectional view taken along the line 9—9 of FIG. 2.

The package structure 10 includes a lid 11 connected along a rear end to a hinge 12 which, in turn, is connected to a rear end of a base 13. The lid 11 is generally flat and rectangular, having an outwardly-extending flange 15 around its periphery. The lid flange 15 is flat, extending outwardly a greater distance along a front end **15*a* to accommodate an opening 16 (FIG. 2). As will become apparent below, the opening 16 can receive an arm (not illustrated) of a display device so that the package 10 hangs from the arm. As best shown in FIGS. 8 and 9, a downwardly-extending wall 17 is integral with the inner edge of the lid flange 15; a generally C-shaped lid channel 18 is integral with the lower edge of the wall 17; and an upper portion of the lid channel 18 curves slightly outwardly from the wall 17 beneath the lid flange 15 before turning inwardly toward a lower portion of the lid channel 18. The lower portion of the lid channel 18 is generally flat and extends inwardly in a direction which is generally parallel to the lid flange 15. The inner edge of the lower portion of the lid channel 18 is integral with an upwardly-extending, inwardly-angled wall 20 which, in turn, is integral with a central planar lid panel 21. The lid panel 21 constitutes most of the surface area of the lid 11. The downwardly-extending wall 17, the lid channel 18, and the inwardly-angled wall 20 extend completely about the periphery of the lid panel 21. connecting the outer ends and sides thereof to the corresponding inner ends and sides of the lid flange 15. As best shown in FIGS. 1, 8, and 9, the lid panel 21 is recessed slightly below the lid flange 15**, typically about an eighth of an inch.

Figure 4:
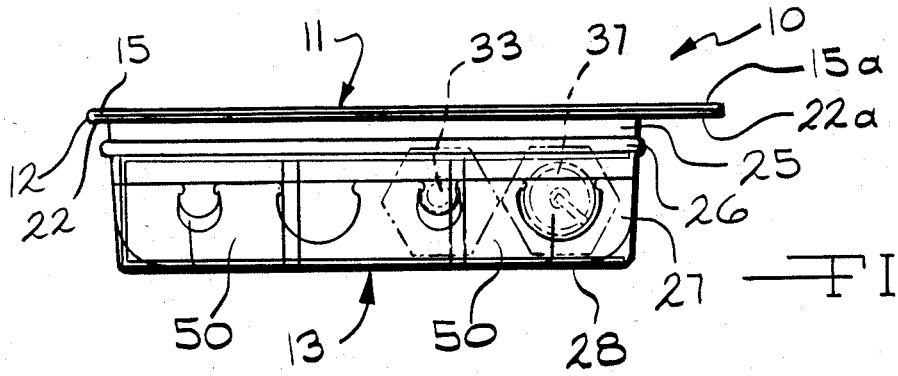
FIG. 4 is a side view in elevation of the package structure, seen as indicated by the line 4—4 of FIG. 2.
Figure 5:
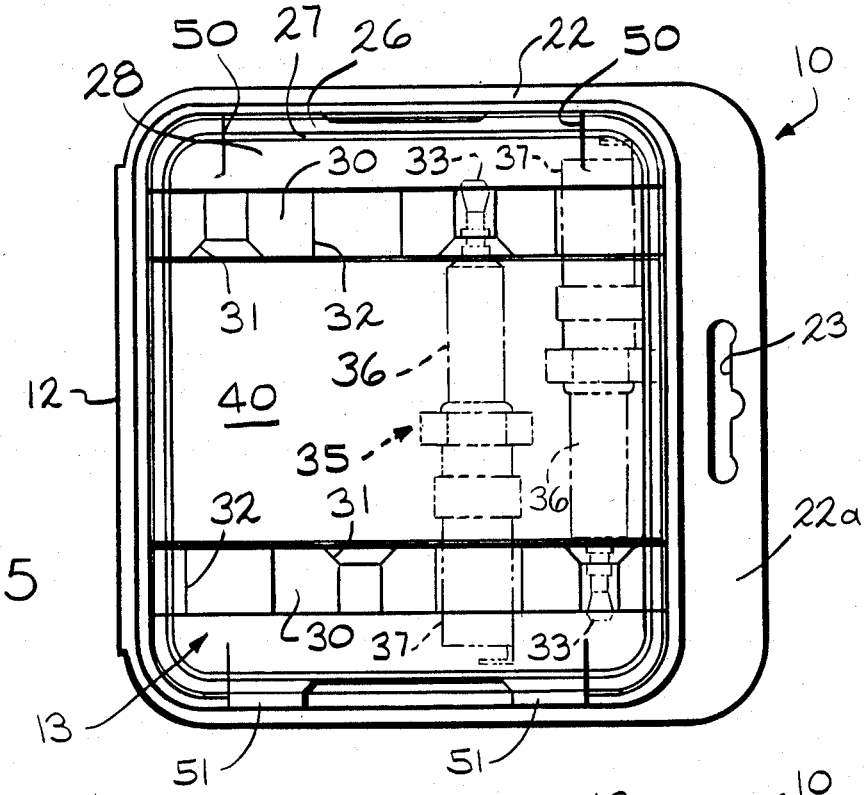
FIG. 5 is a bottom plan view of the package structure of FIG. 1.
Figure 6:
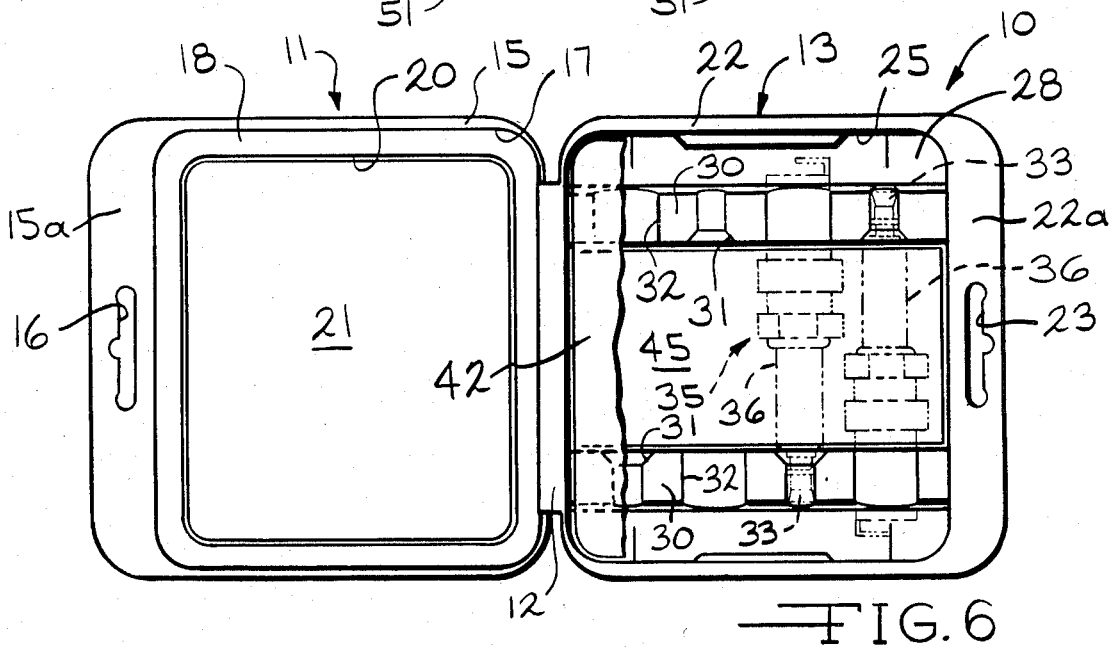
FIG. 6 is a top plan view, partially broken away, of the package structure of FIG. 1, the lid being shown in an open position.
Figure 7:
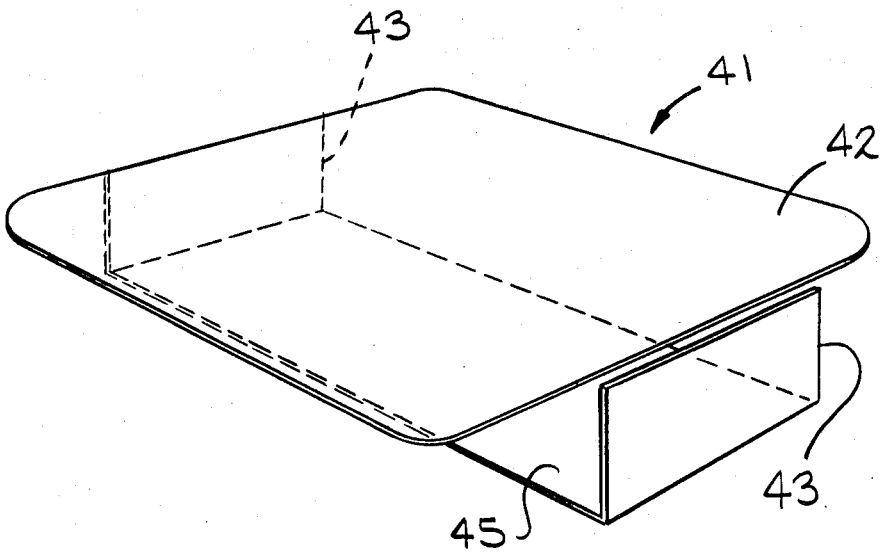
FIG. 7 is a perspective view of a reinforcing insert which is disposed within the package structure of FIG. 1.

As mentioned above, the portion of the lid flange 15 which extends along the rear end of the lid 11 opposite the front end 15*a* is connected to the hinge 12, to which the base 13 is connected (see FIG. 6). The base 13 has an outwardly-extending base flange 22 about its periphery. The base flange 22 is flat and extends outwardly about the base 13, having an enlarged front end 22*a* with an opening 23 therethrough. The base flange opening 23 is sized and positioned to be co-extensive with the lid flange opening 16 when the lid 11 is in the closed position, as shown in FIGS. 2 and 5. It is the portion of the base flange 22 which extends along the rear end of the base 13 opposite the enlarged front end 22*a* which is connected to the hinge 12. As shown in FIGS. 4 and 8, the lid flange 15, the base flange 22 and the hinge 12 are all integral with one-another, constituting a single piece of material folded over upon itself.

As best shown in FIGS. 8 and 9, the base flange 22, a base wall 25, a generally C-shaped base channel 26, a lower wall 27 and a planar, central base panel 28 are all integral with one another. The wall 25 extends downwardly from the inner edge of the base flange 22, while the upper portion of the channel 26 curves slightly outwardly from the wall 25 beneath the base flange 22 before turning inwardly to the lower wall 27. The lower wall 27 extends downwardly from the base flange 22 to the base panel 28, which is generally flat and extends parallel to the lid panel 21. The downwardly-extending wall 25. the base channel 26, and the downwardly-extending lower wall 27 extend completely about the periphery of the base panel 28, connecting the outer ends and sides thereof to the corresponding inner ends and sides of the base flange 22.

As shown most clearly in FIGS. 1, 8, and 9, the corresponding elements of the lid 11 and of the base 13 are adjacent one another when the lid 11 is in a closed position relative to the base 13. The corresponding elements which are adjacent when the lid 11 is in the closed position are: the lid flange 15 and the base flange 22, the lid wall 17 and the base wall 25, and the lid channel 18 and the base channel 26, the outer surface of the curved portion of the lid channel 18 being received within the inner surface of the curved portion of the base channel 26 to secure the entire periphery of the lid 11 in the closed position, thereby providing a firm, yet releasable seal between the lid 11 and the base 13. As will become apparent below, the lid 11 is secured in the closed position until certain forces are applied at specific locations to move it to the open position. Consequently, the chances that the package structure 10 will be opened accidentally are minimal even if the articles contained therein are relatively heavy or if the package structure 10 is roughly handled.

Additionally, because the lid channel 18 and the base channel 26 are releasably engaged, as described above, about the entire periphery thereof, the strength of the package structure 10 as a whole is greatly increased. This is because the curved shaped of the lid channel 18 and of the base channel 26 substantially increase the rigidity of the ends and sides of the lid 11 and of the base 13, respectively, which extend linearly between adjacent corners thereof. The curved lid channel 18 and the curved base channel 26 function as reinforcing ribs which resist flexing because of the relative resistance to elongation and compression of the material utilized to form the package structure 10. Consequently, the magnitude of the force required to flex any linearly-extending edge of the lid 11 or of the base 13 between adjacent corners thereof is greatly increased. The corners of the lid 11 and of the base 13 are also strengthened by the curved lid channel 18 and the curved base channel 26, respectively, but to a lesser extent than the linearly-extending edges. As a result, when the package structure 10 is in the open position, two of the corners of either the lid 11 or the base 13 which are disposed in opposed diagonal relationship can be flexed inwardly toward one another, while the other two corners thereof can be simultaneously flexed outwardly away from one another. The resultant shape of either the lid 11 or the base 13 is generally U-shaped in cross section when viewed diagonally thereacross between opposed corners. Such undesirable flexing can occur because of the lightweight and flexible nature of the material utilized to form the package structure 10.

In the closed position, however, the lid 11 and the base 13 cooperate with each other to prevent such inward and outward movement of the opposed corners thereof and consequent flexing of the package structure 10, because the material utilized to form the lid 11 and the base 13 is resistant to elongation and compression thereof. If an attempt is made to move either of the opposed pairs of corners of either the lid 11 or the base 13 outwardly away from one another, the portion of the lid panel 21 extending diagonally therebetween will be subjected to forces tending to extend it in that direction. Similarly, if an attempt is made to move either of the opposed pairs of corners of either the lid 11 or the base 13 inwardly toward one another, the portion of the lid panel 21 extending diagonally therebetween will be subjected to forces tending to compress it in that direction. In either event, the material utilized to form the lid panel 21 resists such forces. When the package structure 10 is closed, therefore, undesirable flexing thereof in any direction is effectively reduced, and the overall strength of the package structure 10 is greatly increased despite the use of a lightweight and flexible material.

To move the lid 11 from the closed position to the open position shown in FIG. 6, a force must be applied to remove the lid channel 18 from the base channel 26. Preferably, such force is applied by grasping the adjacent portions of the enlarged front ends 15*a* and 22*a* of the lid flange 15 and of the base flange 22, respectively, with the fingers of opposite hands and pulling the lid 11 upwardly away from the base 13. When a force of sufficient magnitude has been so applied, the lid wall 17 and the lid channel 18 extending along the enlarged front end 15*a* will flex inwardly so that the lid channel 18 can be withdrawn from the base channel 26. The magnitude of the force required to accomplish this withdrawal is dependent, among other things, upon the length of the lid channel 18 which extends linearly from the point at which the force is applied. This length, represents the length of the lid channel 18 which must be flexed inwardly out of engagement with the base channel 26, the greater such length, the greater the force required. As mentioned above, the curved shape of the lid channel 18 and of the base channel 26 increases the rigidity of the linearly-extending ends and sides of the lid 11 and of the base 13 between adjacent corners thereof. Thus, not only will the ends and sides of the lid 11 and of the base 13 resist such flexing movement, for the reasons discussed above, but the entire linear length of each end and side thereof will tend to move as a unit. As a result, any force which tends to flex the lid channel 18 out of engagement with the base channel 26, must cause such flexing along the entire length of the lid channel 18 extending linearly from the point at which the force is applied. Thus, a relatively large force must be applied near the center of the enlarged front end 15a because the entire length of the lid channel 18 extending along such enlarged front end 15*a* must be flexed inwardly out of engagement with the base channel 26. However, only a relatively small force is required if applied at either of the corners of the enlarged ends 15*a* and 22*a*, since the lid channel 18 extends only a short distance linearly therefrom. Also, a relatively small force is required because the corner of the lid 11 is being moved out of cooperation with the base 13. Thus, the previously described reinforcing aspects of the lid panel 21 do not occur after one of the corners of the lid is removed from engagement with the corresponding corner of the base 13. As a result, there is only a relatively short portion of the lid channel 18, approximately the length of such corner, to be flexed out of engagement with the base channel 26.

Once an initial portion of the lid channel 18 is removed from the base channel 26, the balance of the lid channel 18 is easily removed therefrom with a minimal amount of force. This is because the increased rigidity of the periphery of the lid 11 causes the portion of the lid channel 18 which has been removed to act as a wedge to flex the lower wall 27 and the base channel 26 outwardly and the lid wall 17 and the lid channel 18 inwardly during removal. Thus, the remaining portion of the lid channel 18 which extends along the enlarged front end 15*a* (if any) and the portions of the lid channel 18 which extend along the sides of the lid 11 and along the rear end adjacent the hinge 12 are quickly and easily removed from the base channel 26, so that the lid 11 can be moved to the open position shown in FIG. 6.

To move the lid 11 from the open position to the closed position, the above-described process is reversed. The lid 11 can be pivoted quickly and easily to a position wherein the portions of the lid channel 18 which extend along the sides of the lid 11 and along the rear end adjacent the hinge 12 are moved into the corresponding portions of the base channel 26; the same above described wedge-like portions of the lid channel 18 occurs during closing. In order to move the final portion of the lid channel 18, which extends along the enlarged front end 15*a*, into the corresponding portion of the base channel 26, a force can be applied to the corresponding corner of the enlarged ends 15*a* and 22*a*, urging them together. When forces of sufficient magnitude have been so applied, the remaining portion of the lid channel 18 which extends along the enlarged end 15*a* will pop into the corresponding portion of the base channel 26. The above-described opening and closing processes can be repeated as necessary to open and close the package structure 10.

The base panel 28 includes integral raised portions 10 (FIGS. 1 and 2) for supporting and retaining spark plugs within the package structure 10. The raised portions 30 extend upwardly from the base panel 28 toward the lid panel 21; they are parallel to one another and to the opposed sides of the package structure 10, extending from the rear end of the lower wall 27 adjacent the hinge 12 to the front end of the lower wall 27 adjacent the enlarged front end 22*a*. Each of the raised portions 30 has a plurality of recesses 31 of relatively small size, and a plurality of recesses 32 of a relatively large size. Each of the recesses 31 is sized to receive a terminal 33 of a spark plug 35 (shown in dotted lines in FIG. 2) and is tapered to accommodate a portion of an insulator 36 of slightly enlarged diameter. Similarly, each of the recesses 32 is sized to receive a threaded portion 37 of the spark plug 35. The recesses 31 and 32 have opposed lip portions 31a and 32*a*, respectively, as best shown in FIG. 8, which extend inwardly toward one another to engage the terminal 33 and the threaded portion 36 of a spark plug 35 received in two aligned recesses 31 and 32. As a result, both ends of the spark plug 35 are releasably retained within the recesses 31 and 32.

A relatively slight force is required to flex the lip portions 31*a* and 32*a* outwardly to enable removal of a spark plug 35 engaged in the recesses 31 and 32, the force required, however, being great enough that spark plugs 35 remain in the recesses 31 and 32 during normal handling and jostling of the package structure 10. The spark plugs 35 cannot be removed from the recesses 31 and 32 when the lid 11 is in the closed position. As best shown in FIGS. 8 and 9, the lid panel 21 abuts the spark plugs 35 when the lid 11 is in the closed position, preventing upward movement of the spark plugs 35 in the recesses 31 and 32. Alternatively, the spark plugs 35 can be spaced a small distance from the lid panel 21, preventing the spark plugs 35 from moving upwardly enough for removal from the recesses 31 and 32. In either case, so long as the lid 11 remains in the closed position, the retained spark plugs 15 are prevented from contacting each other, thus reducing the possibility of damage to the insulator 36 or change of the gap settings. As shown in FIGS. 2 and 5, the recesses 31 and 32 can be formed so as to position adjacent ones of the spark plugs 35 so that they are slightly offset from one another. This enables the spark plugs 35 to be positioned closer together, thereby reducing the amount of wasted space in the package structure 10.

Between the two raised portions 30, the base panel 28 has a central region 40 which is planar and extends from the front lower wall 27, adjacent the enlarged front end 22*a* to the rear lower wall 27 adjacent the hinge 12. The central portion 40 has a predetermined width which is the distance by which the raised portions 30 are separated from one another. The package structure 10 also includes an insert indicated generally at 41 in FIG. 7, which comprises a top portion 42, opposed end portions 43, and a bottom portion 45. Each of the portions 42, 43, and 45 is planar; the entire insert 41 can be formed from a single piece of appropriately shaped sheet material by folding to define the individual portions 42, 43, and 45. The bottom portion 45 of the insert 41 is sized to extend completely over the central region 40 of the base panel 28 (FIGS. 8 and 9) extending from one to the other of the raised portions 30 and from the front lower wall 27 adjacent the enlarged front end 22*a* to the rear lower wall 27 adjacent the hinge 12. The end portions 43 of the insert 41 have the same width as the bottom portion 45 and a height which is equal to the height of the rear lower wall 27 adjacent the hinge 12. The top portion 42 of the insert 41 is coextensive with the central panel 21 of the lid 11, extending adjacent the inwardly-angled wall 20 and into the corners thereof as shown in FIGS. 1, 6, 8, and 9. The raised portions 30 position the spark plugs 35 so that they abut the top potion 42 of the insert 41 and urge it upwardly against the bottom surface of the lid panel 21 when the lid 11 is closed, as shown in FIGS. 8 and 9. Thus, when the lid 11 is closed, the top portion 42 of the insert 41 is adjacent the bottom surface of the lid panel 21.

The insert 41 is a relatively rigid cardboard, such as twelve point solid bleached sulfate paperboard. Other materials can be utilized, but the paperboard has all of the requisites of accepting printing as desired for graphic presentation and of being relatively rigid so that it strengthens the package structure and prevents flexing thereof when the lid 11 is in the closed position. The strengthening occurs because the top portion 42 of the insert 41 extends into the corners of the lid panel 21, adjacent the inwardly-extending wall 20. When a force is applied which would tend to flex the opposed diagonal corners of the lid 11 or of the base 13, as described above, the inward movement of the opposed corners is resisted by the top portion 42. The bottom portion 45 of the insert 41 functions in a similar manner because it abuts the corners of the planar central region 40, as described above. It will be appreciated that this same reinforcing function can be achieved even if the top portion 45 and the bottom portion 42 of the insert 41 are separate pieces, and the end portions 43 are omitted or not attached.

Alternatively, the dimensions of the package 10 can be changed so that the lower wall 27 extends above spark plugs 35 engaged in the recesses 31 and 32; the bottom portion 45 of the insert 41 can then be positioned as described above, while the top portion 42 thereof extends above the spark plugs 35 into abutment with the lower wall 27 of the base 13. For the insert 41 to provide additional reinforcement, the corners of at least one of the top and bottom portions 42 and 45 must extend into abutment with the corresponding corners of the package structure 10.

Figure 3:
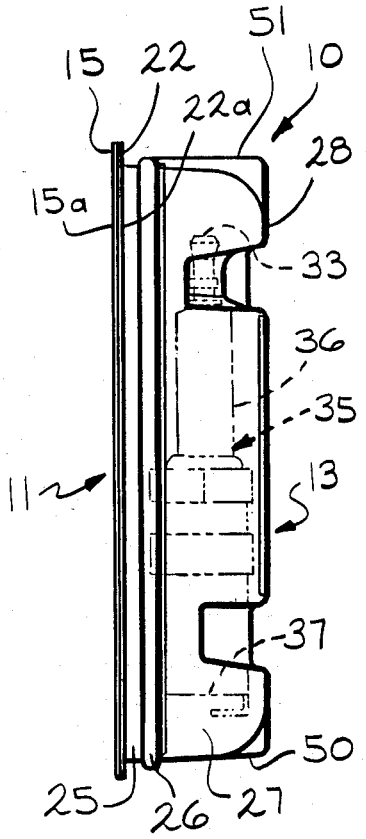
FIG. 3 is an end view in elevation of the package structure, seen as indicated by the line 3—3 of FIG. 2.

As best shown in FIGS. 3 and 9, the lower wall 27 of the package structure 10 tapers inwardly from the top to the bottom, the angle of taper being approximately seven degrees. On one side of the package structure (the bottom side of FIG. 3 and the left side of FIG. 9), there are reinforcing embossments 50 integral with the wall 27. The embossments 50 increase the strength of the lower wall 27. On the opposite side of the package structure (the top side of FIG. 3 and the right side of FIG. 9),there are feet 51 which extend downwardly from the base channel 26 generally perpendicularly to the plane of the lid panel 21. The feet 51, the outermost edges of the lid flange 15 and the base flange 22 constitute a base on which the package structure 10 can stand. The size and number of the feet 51, and the sizes of the lid and base flanges 15 and 22 are such that the package structure 10 is relatively stable when standing as described. It will be appreciated that feet 51 can be provided on both sides of the package structure 10, if desired.

The package structure 10 of the present invention has many advantages over prior art package structures. First, because of the unique self-reinforcing aspects of the lid 11 and of the base 13 described above, much lighter material can be used to produce stronger packaging suitable for relatively heavy articles, such as spark plugs 35. Second the package structure 10 can be manufactured simply and inexpensively, for example, from a single sheet of a synthetic resinous material. The package structure 10 can be produced using conventional, in line, intermittent vacuum thermoforming techniques. Further, the package structure 10 has significant advantage in shipping and display, its tapered sides making it possible for the base panel 28 of a first package structure 10 to be received within the lid wall 17 of a second package structure 10. Consequently, the package structures 10 have excellent stacking characteristics, shifting and tipping being effectively prevented. The structure 10 can also hang from an arm which is received in the aligned openings 16 and 23 in the lid flange 15 and the base flange 22. Alternatively, the structure 10 can stand on the base which includes the feet 51 for display. Lastly, the package structure 10 efficiently retains the spark plugs 35 therein, even when opened, disposed in alternating fashion, offset from one another, thereby achieving a denser packaging pattern than was previously possible.

Figure 10:
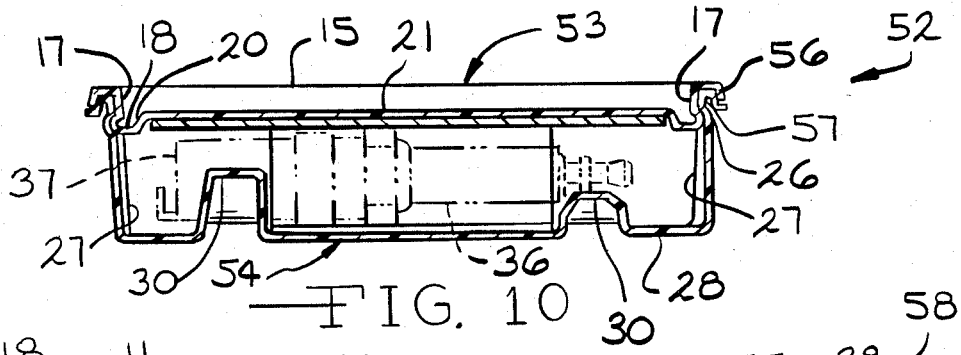
FIG. 10 is a vertical sectional view similar to FIG. 9, but showing a preferred structure.

A preferred package structure according to the instant invention is indicated generally at 52 in FIG. 10. As is indicated by the use of the same reference numerals, most of the elements of the package structure 52 are the same as the corresponding elements of the package structure 10 of FIGS. 1 through 9, the lid 11 and the base 13 being replaced by a lid 53 (FIG. 10) and a base 54 which differ as explained below. The lid 53 is generally flat and rectangular having an outwardly extending flange 55 around its periphery. The flange 55 is generally flat except for an outer terminal portion 56 which extends downwardly from the flange 55 and outwardly, away from the package structure 52. The base 54 has the planar base panel 28, the lower wall 27 which extends upwardly therefrom to the C-shaped base channel 26, and a terminal portion 57 which extends upwardly adjacent the outside of the wall 17, outwardly adjacent the bottom of the flange 55, downwardly adjacent and then outwardly under the outer terminal portion 56. The terminal portion 57 in this structure is locked against movement either to the right or to the left in FIG. 10 so that bowing of the walls 27 is resisted. This locking arrangement is continued around the entire periphery of the package structure 52. The package structure 52 benefits from the strengthening features which are discussed above with reference to the package structure 10 of FIGS. 1–9.

Figure 11:
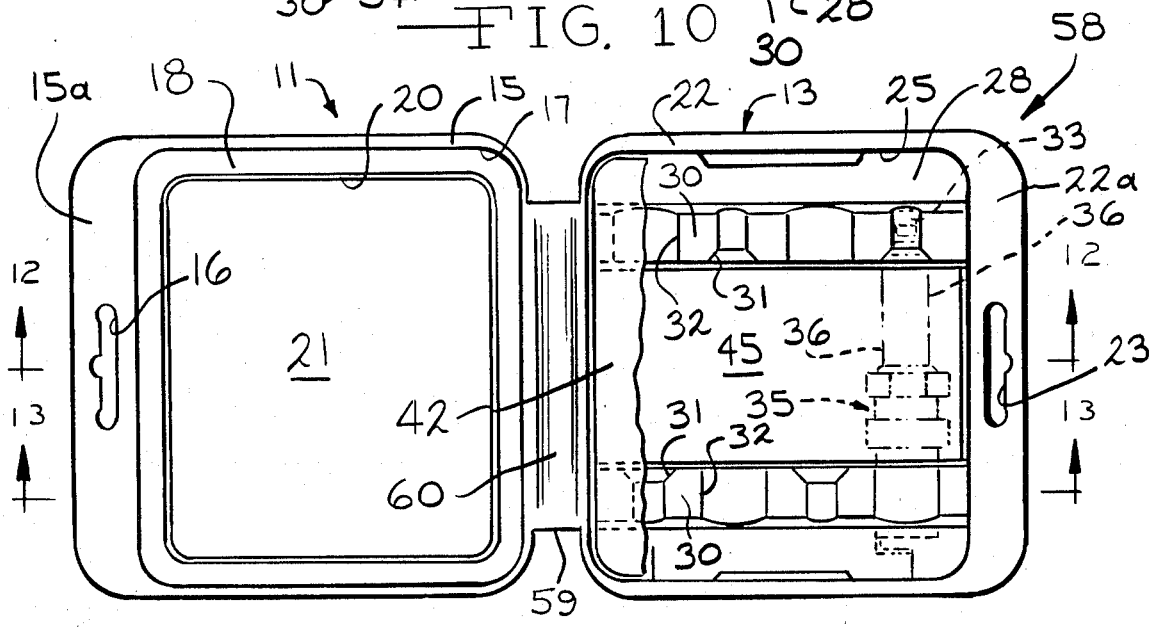
FIG. 11 is a top plan view, partially broken away, of an improved package structure, the lid being shown in an open position.
Figure 12:
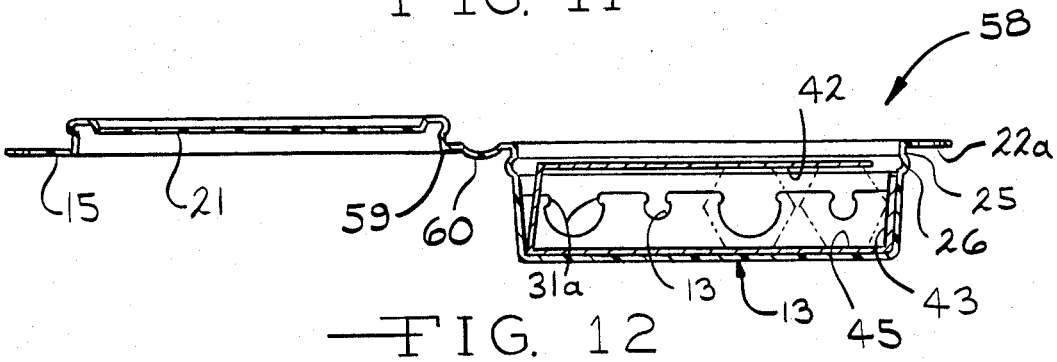
FIG. 12 is a view in vertical section taken along the line 12—12 of FIG. 11.
Figure 13:
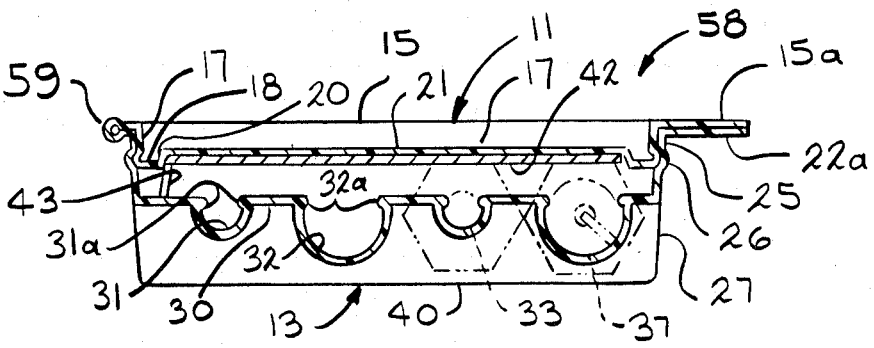
FIG. 13 is a vertical sectional view similar to FIG. 12, but showing the lid in a closed position.

Another preferred package structure is indicated generally at 58 in FIGS. 11 through 13. The package structure 58 comprises the lid 11, the base 13, and a hinge 59 which connects the two. The hinge 59, when the lid is in the open position as shown in FIGS. 11 and 12, has a central arcuate portion 60 which is flexed into a circular cross section when the lid is closed, as shown in FIG. 13. The arcuate portion 60 of the hinge 59 is capable of repeated flexing without cracking as the lid of the package structure 58 is opened and closed.

Figure 14:
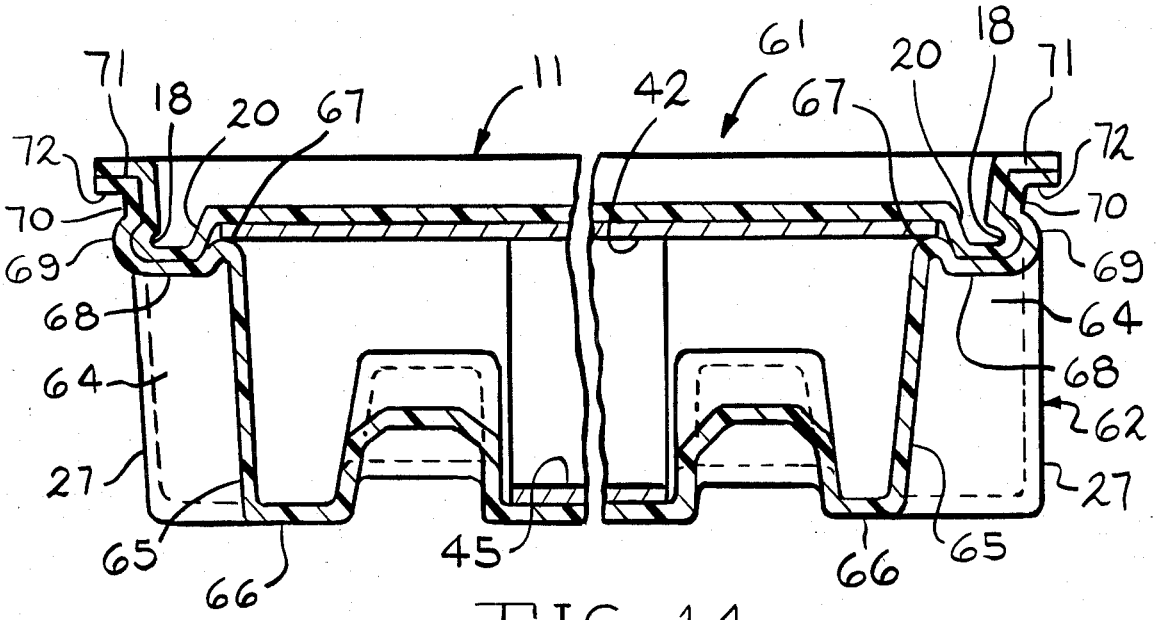
FIG. 14 is a vertical sectional view taken along the line 14—14 of FIG. 15 showing still another embodiment of a package structure according to the invention, the lid being shown in a closed position.
Figure 15:
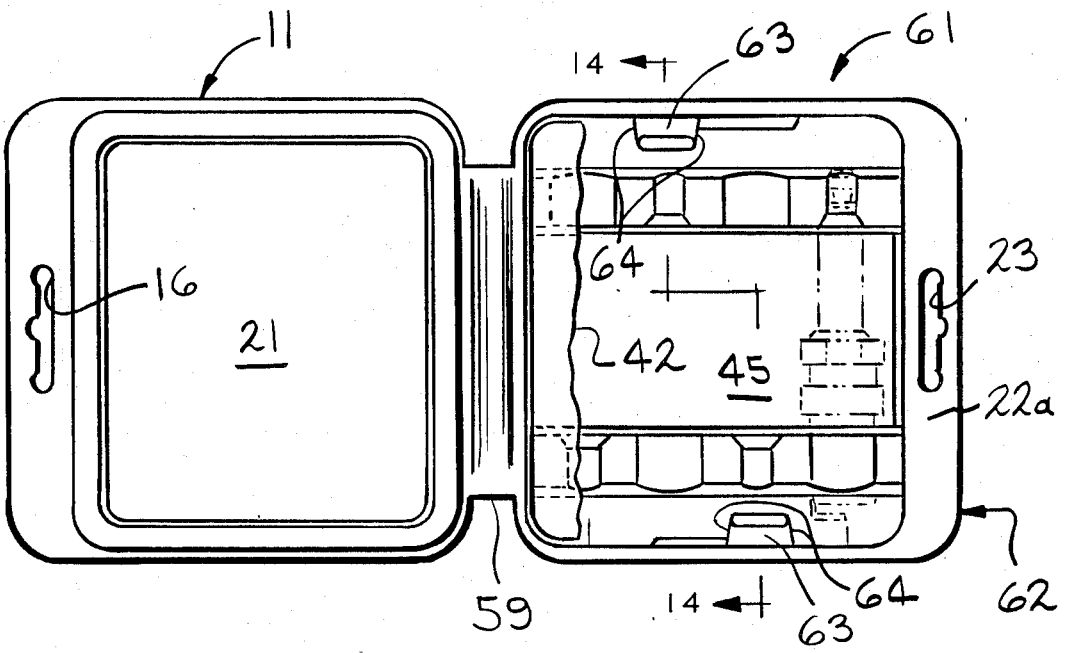
FIG. 15 is a top plan view of the package structure of FIG. 14, the lid being shown in an open position.

Still another preferred package structure according to the invention is indicated generally at 61 in FIGS. 14 and 15. The package structure 61 comprises the lid 11, the hinge 59 and a base 62 which, as is indicated by the use of many of the same reference numerals, is the same in most respects as the base 13 of FIGS. 1 through 9 and 11 through 13. As best seen in FIG. 15, there is a reentrant portion 63 between side walls 64 which extend inwardly from the lower wall 27 on each side of the base 62. A back wall 65 (see FIG. 14) extends generally upwardly from a bottom wall 66 between and integral with the side walls 64 at the rear of each of the reentrant portions 63. The back wall 65 has a reverse bend as indicated at 67, then extends outwardly as indicated at 68, makes a return bend as indicated at 69, then extends upwardly as indicated at 70 to another bend indicated at 71 and extends outwardly as indicated at 72. When the lid 11 of the package structure 61 is closed, as shown in FIG. 14, the lid flange 18 thereof is received interiorly of the return bend 69 and the wall 20 thereof abuts the reverse bend 67. As a consequence, the upper end of the wall 65 is locked against movement either to the left or to the right; this is particularly advantageous when a substantial number of the package structures 61 are to be stacked, one on the other, as bowing of the walls 27 on the sides of the package structures is prevented.

Figure 16:
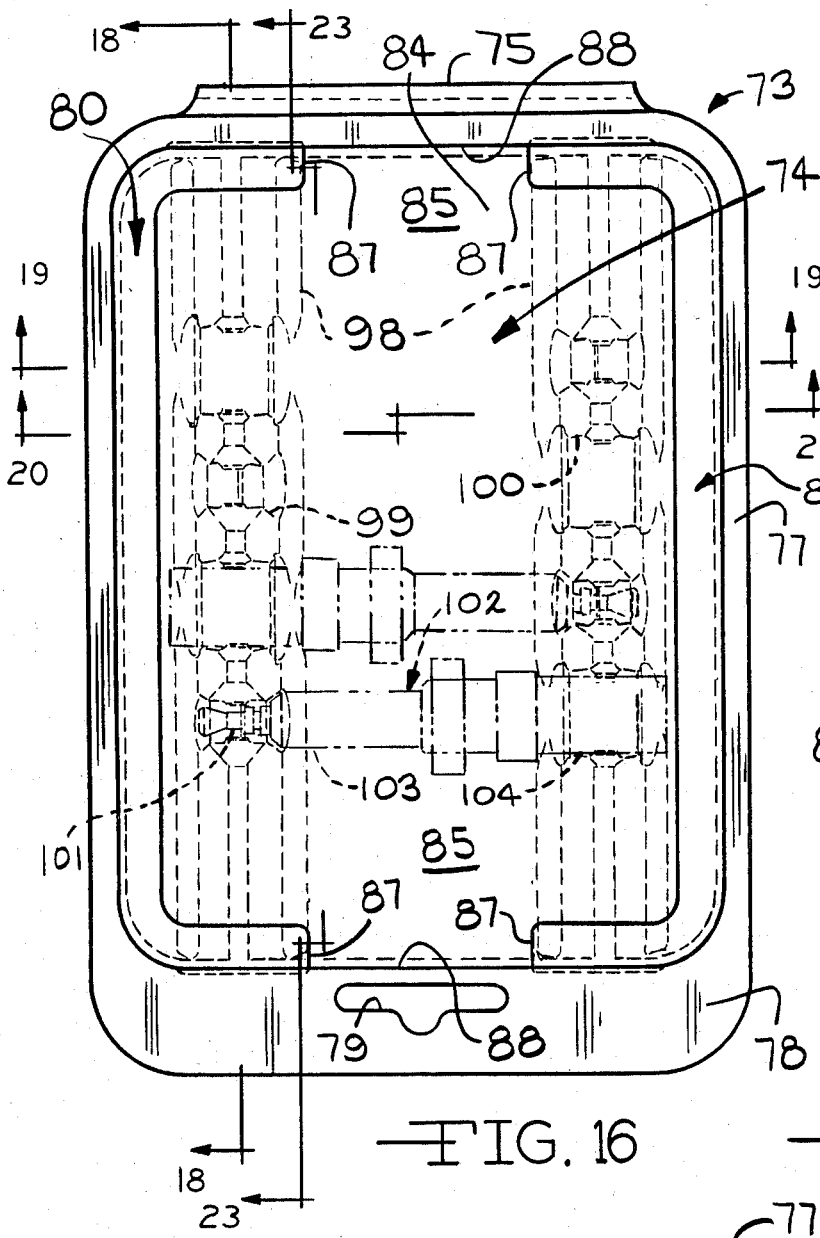
FIG. 16 is a top plan view of another embodiment of an improved package structure in accordance with the present invention, the lid being shown in a closed position.
Figure 18:
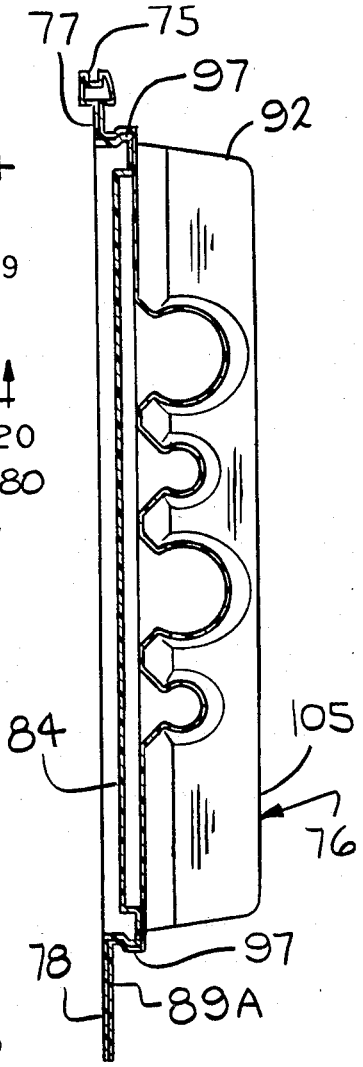
FIG. 18 is a vertical sectional view taken along the line 18—18 of FIG. 16.
Figure 19:
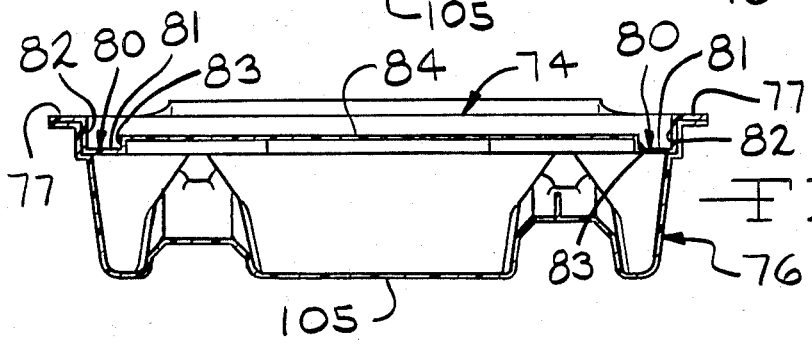
FIG. 19 is a vertical sectional view taken along the line 19—19 of FIG. 16.
Figure 20:
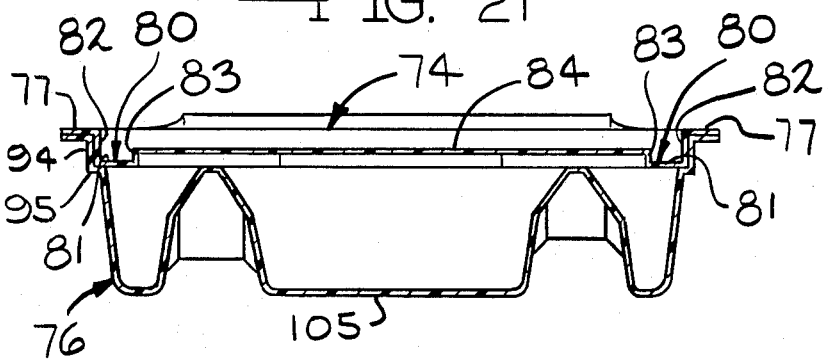
FIG. 20 is a vertical sectional view taken along the line 20—20 of FIG. 16.
Figure 22:
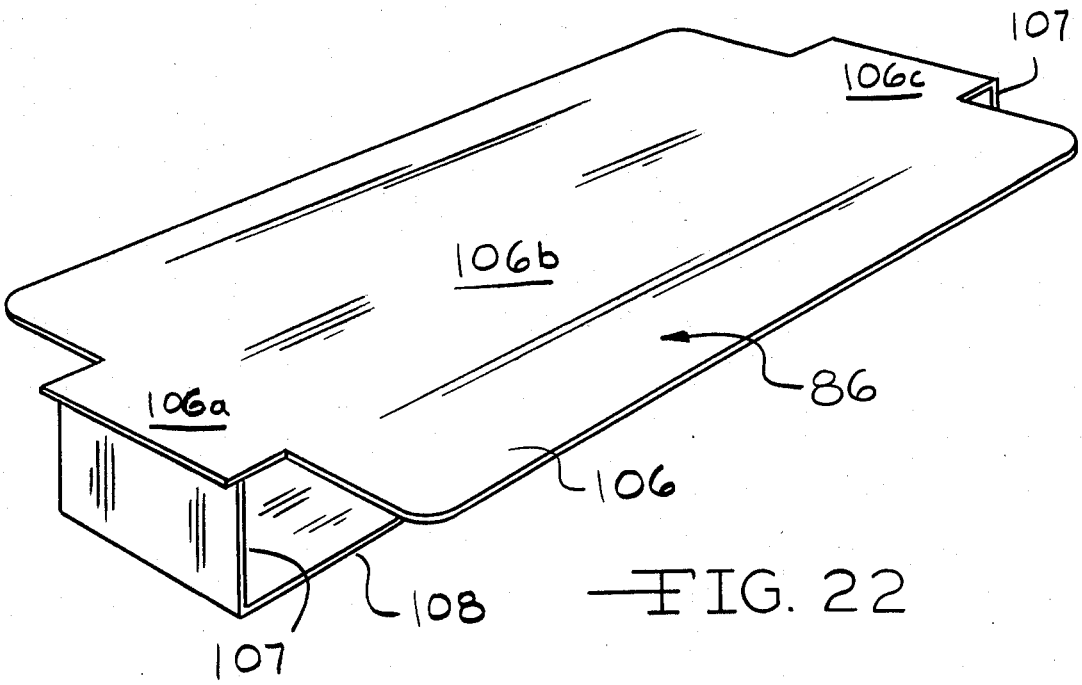
FIG. 22 is a perspective view of a reinforcing insert which is disposed within the package structure of FIG. 16.

Yet another preferred package structure according to the instant invention, indicated generally at 73 in FIG. 16, is shown in FIGS. 16–23. The package structure 73, which constitutes the best mode presently contemplated by the inventor, includes a lid 74 connected along a rear end to a hinge 75 which, in turn, is connected to a rear end of a base 76. The lid 74 is generally flat and rectangular, having an outwardly-extending flange 77 around its periphery. The lid flange 77 is flat, extending outwardly a greater distance along a front end 78 to accommodate an opening 79. As will become apparent below, the opening 79 can receive an arm (not illustrated) of a display device so that the package 73 hangs from the arm. As best shown in FIGS. 19 and 20, the lid 74 has two lid channels 80, each composed of a web 81 and side-walls 82 and 83. The side-walls 82, which are integral with the inner edge of the lid flange 77, is longer than the side-wall 83, which is integral with a lid panel 84, that constitutes most of the surface area of the lid 74. Each of the lid channels 80, as best shown in FIG. 16, extends completely along one of two of the opposed edges of the lid panel 84, and inwardly from each of the corners of the edge along the other two of the opposed edges, but terminates short of central regions 85 adjacent the latter two opposed edges to accommodate an insert 86, as subsequently explained in more detail. As best shown in FIGS. 18, 19, 20, and 23, the lid panel 84 is recessed slightly below the lid flange 77, typically about an eighth of an inch. As previously stated, the lid panel 84 is integral with the side-walls 83; it is also integral with end walls 87 (FIG. 16), one of which closes the terminus of each of the channels 80 and with wall portions 88 which are essentially extensions of the side-walls 82, and are also integral with the lid flanges 77 and 78.

Figure 23:
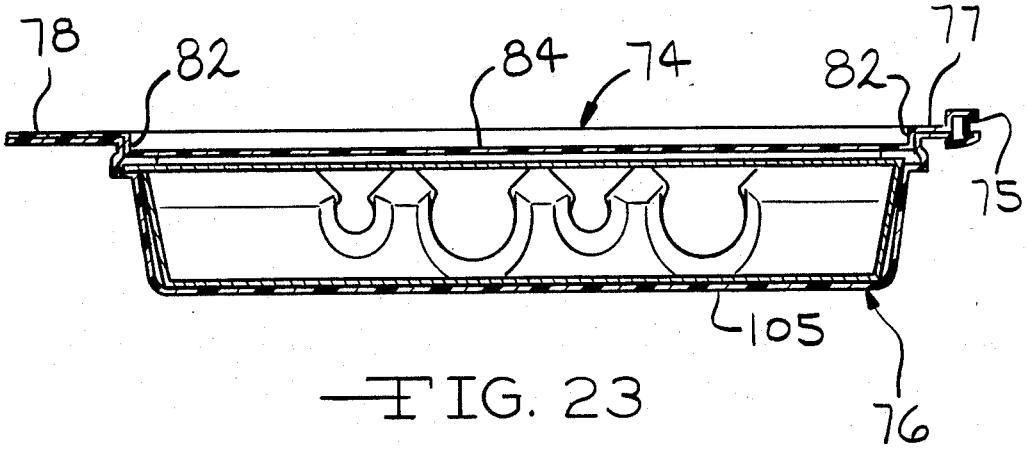
FIG. 23 is a vertical sectional view taken along the line 23—23 of FIG. 16, the reinforcing insert of FIG. 22 being omitted to facilitate showing the structure.

As mentioned above, the portion of the lid flange 77 which extends along the rear end of the lid 74 opposite the front end 78 is connected to the hinge 75, to which the base 76 is connected. The base 76 (see FIG. 21) has an outwardly-extending base flange 89 about its periphery. The base flange 89 is flat and extends outwardly about the base 76, having an enlarged front end 89A with an opening 90 therethrough. The base flange opening 90 is sized and positioned to be co-extensive with the lid flange opening 79 when the lid 74 is in the closed position, as shown in FIG. 16. Referring, again, to FIG. 21, the portion of the base flange 89 which extends along the rear end of the base 76 opposite the enlarged front end 89A is also connected to the hinge 75. As shown in FIGS. 18 and 23, the lid flange 77, the base flange 89 and the hinge 75 are all integral with one-other, constituting a single piece of material folded over upon itself.

Figure 24:
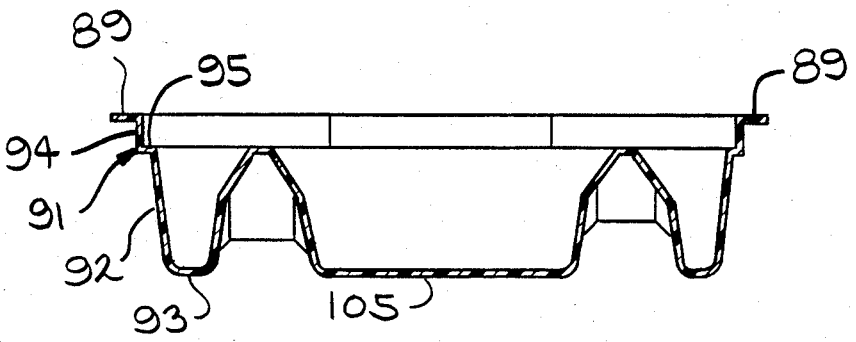
FIG. 24 is a vertical sectional view taken along the line 24—24 of FIG. 21.

As best shown in FIG. 24, the base flange 89, a stepped wall portion 91, a lower wall 92 and a planar, base panel 93 are all integral with one another. The stepped wall portion 91 has a vertical wall94 which extends downwardly from the inner edge of the base flange 89, and a horizontal wall 95 which extends inwardly to the lower wall 92. The base panel 93 is generally flat and extends parallel to the base flange 89. The stepped wall portion 91 and the lower wall 92 extend completely about the periphery of the base panel 93, connecting the outer ends and sides thereof to the corresponding inner ends and sides of the base flange 89 and of the front end 89A (FIG. 21).

As shown most clearly in FIGS. 18, 19, 20 and 23, the sidewalls 82 of the lid channels 80 and the wall portions 88 of the lid 74 are adjacent the vertical wall 94 of the base 76 and the webs 81 of the lid channels 80 bear against the horizontal wall 95 of the base 76 when the lid 74 is in a closed position relative to the base 76. There are four recesses 96 (FIG. 21) in the vertical wall 94 of the base 76, and there are four raised regions 97 on the side-walls 82 of the channels 80 of the lid 74. When the lid 74 is in a closed position relative to the base 76 the raised regions 97 are received within the recesses 96 to secure the lid 74 in the closed position, thereby providing a firm, yet releasable seal between the lid 74 and the base 76. As will become apparent below, the lid 74 is secured in the closed position until certain forces are applied at specific locations to move it to the open position. Consequently, the chances that the package structure 73 will be opened accidentally are minimal even if the articles contained therein are relatively heavy or if the package structure is roughly handled.

Additionally, because the raised regions 97 and the recesses 96 are releasably engaged, as described above, while the side-walls 82 and wall portions 88 abut the vertical wall 94 about the entire periphery thereof, the strength of the package structure 73 as a whole is greatly increased. Consequently, the magnitude of the force required to flex any linearly-extending edge of the lid 74 or of the base 76 between adjacent corners thereof is greatly increased. The corners of the lid 74 and of the base 76 are also strengthened by the lid channels 80 and the abutting vertical wall 94.

Figure 21:
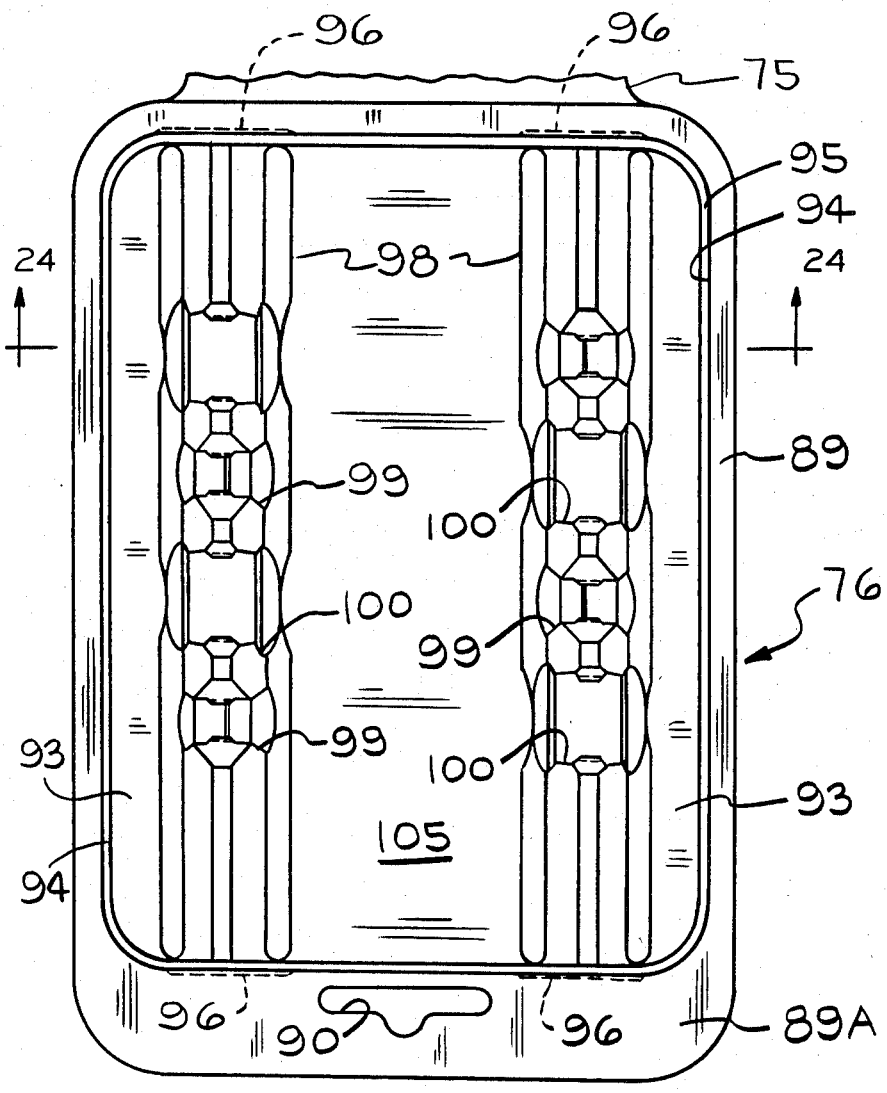
FIG. 21 is a top plan view of the package structure of FIG. 16, the lid being in an open position, but broken away.

To move the lid 74 from the closed position to the open position shown in FIG. 21, a force must be applied to remove the raised regions 97 of the lid 74 from the recesses 96 of the base 76. Preferably, such force is applied by grasping the adjacent portions of the enlarged front ends 78 and 89A of the lid flange 77 and of the base flange 89, respectively, with the fingers of opposite hands and pulling the lid 74 upwardly away from the base 76. When a force of sufficient magnitude has been so applied, one of the raised regions will be removed from the corresponding recess; the package will then flex readily so that completing the opening thereof can be accomplished easily.

The base panel 93 (see FIG. 21) includes integral raised portions 98 for supporting and retaining spark plugs within the package structure 73. The raised portions 98 extend upwardly from the base panel 93 toward the lid panel 84; they are parallel to one another and to the opposed sides of the package structure 73, extending from the rear end to the forward end of the base panel 93. Each of the raised portions 98 has two recesses 99 of relatively small size, and two recesses 100 of a relatively large size. Each of the recesses 99 is sized to receive a terminal 101 of a spark plug 102 (two of which are shown in dotted lines) and is tapered to accommodate a portion of an insulator 103 of slightly enlarged diameter. Similarly, each of the recesses 100 is sized to receive a threaded portion 104 of the spark plug 102.

Between the two raised portions 98, the base panel 90 has a central region 105 which is planar and extends from the front lower wall 92 adjacent the enlarged front end 89A to the rear lower wall 92 adjacent the hinge 75. The central region 105 has a predetermined width which is the distance by which the raised portions 98 are separated from one another. The insert 86, which is shown in perspective in FIG. 22, comprises a top portion 106, opposed end portions 107, and a bottom portion 108. Each of the portions 106, 107, and 108 is planar; the entire insert 86 can be formed from a single piece of appropriately shaped sheet material by folding to define the individual portions 106, 107, and 108. The bottom portion 108 of the insert 86 is sized to extend completely over the central region 105 of the base panel 93 (FIG. 21) extending from one to the other of the raised portions 98 and from the front lower wall 92 adjacent the enlarged front end 89A to the rear lower wall 92 adjacent the hinge 75. The end portions 107 of the insert 86 have the same width as the bottom portion 108 and a height which is equal to the height of the rear lower wall 92 adjacent the hinge 75. The top portion 106 of the insert 86 is coextensive with the lid panel 84 of the lid 74, extending adjacent the side-walls 83 of the channel 80 and into the corners thereof as shown in FIGS. 16 and 23. The raised portions 98 position the spark plugs 102 so that they abut the top portion 106 of the insert 86 and urge it upwardly against the bottom surface of the lid panel 84 when the lid 74 is closed, as shown in FIG. 23. Thus, when the lid 74 is closed, the top portion 106 of the insert 86 is adjacent the bottom surface of the lid panel 84.

Figure 17:
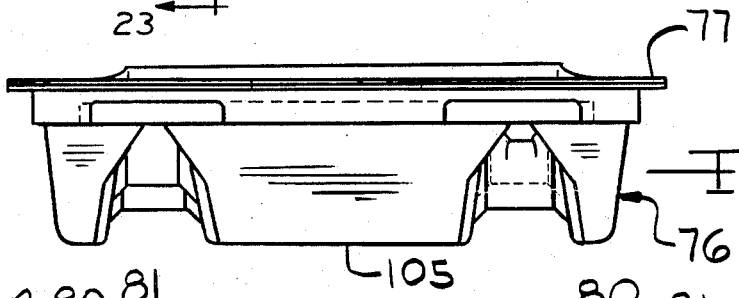
FIG. 17 is an end view in elevation of the package structure FIG. 16.

As is stated above, the bottom portion 108 of the insert 86 is sized to extend completely over the central region 105 of the base panel 93 (FIG. 21) extending from one to the other of the raised portions 98 and from the front lower wall 92 adjacent the enlarged front end 89A to the rear lower wall 92 adjacent the hinge 75. As can be seen in FIGS. 16 and 17, the distance from the front lower wall 92 to the rear lower wall 92 is greater than the distance between the channels 80 from from to rear of the lid panel 84. The top 106 of the insert 86 (FIG. 22) has the same length as the bottom 108, but is composed of a forward portion **106*a*, a central portion 106*b* and a rear portion 106*c*. The central portion 106*b* is sized so that it abuts the sidewalls 83 of the channels 80 (see FIG. 16) while the forward portion 106*a* is sized so that it abuts the end walls 87 at the front of the package 73 and the rear portion 106*c* is sized so that it abuts the end walls 87 at the rear of the package 73. The top 106 is also sized so that its forward and rear ends abut the forward and rear end walls 88**.

The insert 86 is a relatively rigid cardboard, such as twelve point solid bleached sulfate paperboard. Other materials can be utilized, but the paperboard has all of the requisites of accepting printing as desired for graphic presentation and of being relatively rigid so that it strengthens the package structure and prevents flexing thereof when the lid 74 is in the closed position. The strengthening occurs because the top portion 106 of the insert 86 extends into the corners of the lid panel 84, adjacent the sidewalls 83 and the walls 88. When a force is applied which would tend to flex the opposed diagonal corners of the lid 74 or of the base 76, as described above, the inward movement of the opposed corners is resisted by the top portion 106. The bottom portion 108 of the insert functions in a similar manner because it abuts the corners of the planar central region 105, as described above. It will be appreciated that this same reinforcing function can be achieved even if the top portion 106 and the bottom portion 108 of the insert 86 are separate pieces, and the end portions 107 are omitted or not attached.

Alternatively, the dimensions of the package 73 can be changed so that the lower wall 92 extends above spark plugs 102 engaged in the recesses 99 and 100; the bottom portion 108 of the insert 86 can then be positioned as described above, while the top portion 106 thereof extends above the spark plugs 102 into abutment with the lower wall 92 of the base 76. For the insert 86 to provide additional reinforcement, the corners of at least one of the top and bottom portions 106 and 108 must extend into abutment with the corresponding corners of the package structure 73.

Figure 25:
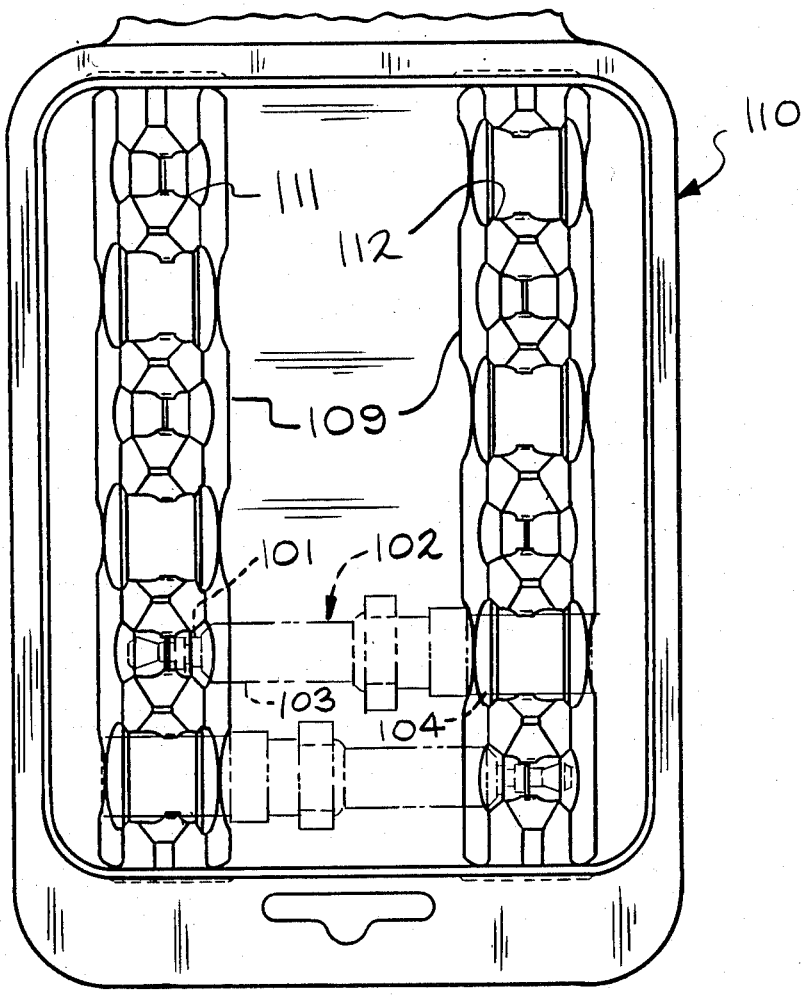
FIG. 25 is a top plan view of a package structure similar to that of FIG. 16, but configured to accommodate a different number of spark plugs, the lid being in an open position, but broken away.

A package structure identical with the structure 73 of FIGS. 16–21, 23 and 24, except that the raised portions 98 have been replaced by raised portions 109 is indicated generally at 110 in FIG. 25. Each of the raised portions 109 has three recesses 111 of relatively small size, and three recesses 112 of a relatively large size. Each of the recesses 111 is sized to receive the terminal 101 of the spark plug 102 (two of which are shown in dotted lines) and is tapered to accommodate a portion of the insulator 103 of slightly enlarged diameter. Similarly, each of the recesses 112 is sized to receive the threaded portion 104 of the spark plug 102.

The package structures 10, 73 and 110 of the present invention have many advantages over prior art package structures. First, because of the unique self-reinforcing aspects of the lids 11 and 74 and of the bases 13 and 76 described above, much lighter material can be used to produce stronger packaging suitable for relatively heavy articles, such as the spark plugs 35 and 102. Second, the package structures 10, 73 and 110 can be manufactured simply and inexpensively, for example, from a single sheet of a synthetic resinous material. The package structures 10, 72 and 110 can be produced using conventional, in line, intermittent vacuum thermoforming techniques. Further, the package structures 10, 73 and 110 have significant advantages in shipping and display, their tapered sides making it possible for the base panel 28 or 93 of a first package structure 10, 73 or 110 to be received within the lid wall 17 or 82 of a second one of the package structures. Consequently, the package structures 10, 73 and 110 have excellent stacking characteristics, shifting and tipping being effectively prevented. The structures 10, 73 and 110 can also hang from an arm which is received in the aligned openings 16 and 23 in the lid flange 15 and the base flange 22 of the package structure 10 or in the corresponding openings of the other structures. Alternatively, the structure 10 can stand on the base which includes the feet 51 for display. Lastly, the package structures 10, 73 and 110 efficiently retain the spark plugs 35 and 102 therein, even when opened, disposed in alternating fashion, offset from one another, thereby achieving a denser packaging pattern than was previously possible.

In accordance with the provisions of the patent statutes, the principle and mode of operation of the present invention have been explained and illustrated in preferred embodiments. However, it is to be understood that the invention can be practiced otherwise than as specifically described with reference to the attached drawings without departing from its spirit and scope. For example, there can be relatively fragile raised embossments on the surfaces of the raised portions 30 which are adjacent the recesses 31 and 32, etc. When spark plugs up to a given diameter are inserted, they are supported by these raised embossments; when spark plugs of larger diameter are inserted, however, a slightly greater force is required because it is necessary to crush the embossments, but the larger diameter plugs are accommodated. Further, higher raised portions 30 and 98 can be used with spaced, parallel walls providing access to the recesses 31 and 32 and 99 and 100 shown in the drawings; specifically, the raised portions 30 and 98 can be sufficiently high that they support the top portions 42 and 106 of the inserts 41 and 86 and, in turn, the lid panels 21 and 84 to provide greater compressive strength for the package structures 10 (FIGS. 1–9), 52 (FIG. 10), 58 (FIGS. 11–13), 73 (FIGS. 16–21 and 23–24) and 110 (FIG. 25). Other changes and modifications will be apparent to those skilled in the packaging art.

I claim:

1. A package structure comprising:

a lid of a flexible material which is relatively resistant to elongation and compression, said lid having a central, substantially planar lid panel, and lid channel means which is integral with, and extends about a major portion of the periphery of, said lid panel;

a base of a flexible material which is relatively resistant to elongation and compression, said base having a generally flat base panel, and a stepped base wall which is integral with, and extends completely around the periphery of, said base panel, said lid and said base being movable relative to one another between an open position and a closed position, said channel means and the step of said stepped base wall abutting one another when said lid and said base are in a closed position, and a base insert adjacent said base panel, interior of said stepped wall, said insert being sufficiently stiff and extending into sufficiently close proximity with opposed portions of said base that it is operable to strengthen said base against flexing.

2. A package structure as claimed in claim 1 wherein the step of said stepped wall is the web of a channel and one of said channel and said channel means is releasably received within the other when said lid and said base are in a closed position.

3. A package structure as claimed in claim 2 wherein said channel means is a channel connected to said lid panel by a lid wall which extends downwardly from said lid panel to said lid channel, and wherein said channel and said wall extend completely about the periphery of said lid panel.

4. A package structure as claimed in claim 3 wherein said lid additionally includes a flat, outwardly-extending lid flange and a lid wall connecting said lid flange and said lid channel, said lid wall extending downwardly from said lid flange to said lid channel.

5. A package structure as claimed in claim 4 wherein said base additionally includes, a flat, outwardly-extending base flange and a base wall, said base wall extending downwardly from said base flange to said base channel.

6. A package structure as claimed in claim 3 which additionally includes a hinge which so connects said lid and said base that the two are rotatable relative to one another about said hinge as an axis between the open position and the closed position.

7. A package structure as claimed in claim 6 which additionally includes a pair of raised portions, one connected to each of two opposed sides of said base panel, and a wall connecting each of said raised portions to a portion of said base wall, each of said raised portions having a recess for releasably engaging a portion of an article contained within the package structure.

8. A package structure as claimed in claim 7 wherein said raised portions extend parallel to one another and to the portions of said base wall to which they are connected.

9. A package structure as claimed in claim 5 which additionally includes a plurality of feet on one side of said base, extending outwardly therefrom, said plurality of feet and said base and lid flanges being operable to constitute a stand for the package structure.

10. A package structures as claimed in claim 9 which additionally includes a second plurality of feet extending outwardly from the side of said base opposite that from which said first feet extend, said second plurality of feet and said base and lid flanges being operable to constitute a second stand for the package structure.

11. A package structure as claimed in claim 3 which additionally includes a lid insert received within said base, said lid insert being so positioned and shaped that it is adjacent the lower surface of said lid panel when said lid is in the closed position, and extends outwardly to said lid wall throughout the periphery of said lid, and being sufficiently stiff that it is operable to strengthen said lid against flexing.

12. A package structure as claimed in claim 11 which additionally includes means urging said lid insert upwardly against said lid panel when said lid is in the closed position.

13. A package structure as claimed in claim 11 which additionally includes a plurality of articles supported in the recesses in said raised portions, and wherein the raised portions are so sized that said articles urge said lid insert upwardly against said lid panel when said lid is in the closed position.

14. A package structure as claimed in claim 1 wherein said lid panel and said base panel are generally rectangular and two opposed lid channels constitute said channel means, one of said lid channels extending along one of a first pair of opposed edges of said lid panel and inwardly along the other two of the opposed edges, and the other of said lid channels extending along the other of the first pair of opposed edges and inwardly along the other two of the opposed edges.

15. A package structure as claimed in claim 14 wherein said lid additionally includes a flat, outwardly-extending lid flange and a lid wall connecting said lid flange and said lid channel, said lid wall extending downwardly from said lid flange to said lid channel.

16. A package structure as claimed in claim 15 wherein said base additionally includes a flat, outwardly-extending base flange and a base wall, said base wall extending downwardly from said base flange to said base channel.

17. A package structure as claimed in claim 14 which additionally includes a hinge which so connects said lid and said base that the two are rotatable relative to one another about said hinge as an axis between the open position and the closed position.

18. A package structure as claimed in claim 14 which additionally includes a pair of raised portions, one connected to each of two opposed sides of said base panel, and a wall connecting each of said raised portions to a portion of said base wall, each of said raised portions having a recess for releasably engaging a portion of an article contained within the package structure.

19. A package structure as claimed in claim 14 which additionally includes a lid insert received within said base, said lid insert being so positioned and shaped that it is adjacent the lower surface of said lid panel when said lid is in the closed position, and extends outwardly to said lid wall throughout the periphery of said lid, and being sufficiently stiff that it is operable to strengthen said lid against flexing.

20. A package structure as claimed in claim 19 which additionally includes means urging said lid insert upwardly against said lid panel when said lid is in the closed position.

21. A package structure as claimed in claim 19 which additionally includes a plurality of articles supported in the recesses in said raised portions, and wherein the raised portions are so sized that said articles urge said lid insert upwardly against said lid panel when said lid is in the closed position.

22. A package structure comprising:

a lid of a flexible material which is relatively resistant to elongation and compression, said lid having
a central, substantially planar lid panel, and
lid channel means which is integral with, and extends about a major portion of the periphery of, said lid panel;

a base of a flexible material which is relatively resistant to elongation and compression, said base having
a generally flat base panel, and
a stepped base wall which is integral with, and extends completely around the periphery of, said base panel, a pair of raised portions, one connected to each of two opposed sides of said base panel, and a wall connecting each of said raised portions to a portion of said base wall, said raised portions extending parallel to one another and to the portions of said base wall to which they are connected, and having first and second pluralities of recesses therein, the first plurality of recesses having a smaller size than the second plurality, the first and second recesses alternating on said raised portions to enable releasable engagement of the opposed ends of a plurality of articles in an alternating fashion, a hinge which so connects said lid and said base that the two are movable relative to one another between an open position and a closed position, said channel means and the step of said stepped base wall abutting one another when said lid and said base are in a closed position, and a base insert adjacent said base panel, interior of said stepped wall, said insert being sufficiently stiff and extending into sufficiently close proximity with opposed portions of said base that it is operable to strengthen said base against flexing.

23. A package structure as claimed in claim 22 wherein each of said raised portions includes a pair of opposed, inwardly-extending lip portions extending partially into an upper portion of each of the recesses to engage an article therein.

24. A package structure as claimed in claim 22 wherein said lid panel and said base panel are generally rectangular and two opposed lid channels constitute said channel means, one of said lid channels extending along one of a first pair of opposed edges of said lid panel and inwardly along the other two of the opposed edges, and the other of said lid channels extending along the other of the first pair of opposed edges and inwardly along the other two of the opposed edges.

25. A package structure as claimed in claim 22 wherein the step of said stepped wall is the web of a channel and one of said channel and said channel means is releasably received within the other when said lid and said base are in a closed position.

26. A package structure as claimed in claim 25 wherein said channel means is a channel connected to said lid panel by a lid wall which extends downwardly from said lid panel to said lid channel, and wherein said channel and said wall extend completely about the periphery of said lid panel.

27. A package structure comprising:

a lid of a flexible material which is relatively resistant to elongation and compression, said lid having
a central, substantially planar lid panel, and
lid channel means which is integral with, and extends about a major portion of the periphery of, said lid panel;

a base of a flexible material which is relatively resistant to elongation and compression, said base having
a generally flat base panel, and
a stepped base wall which is integral with, and extends completely around the periphery of, said base panel, said lid and said base being movable relative to one another between an open position and a closed position, said channel means and the step of said stepped base wall abutting one another when said lid and said base are in a closed position, and an insert comprising
a base portion positioned adjacent said base panel and extending into close proximity with opposed portions of said base, said base insert being operable to strengthen said base against flexing,
a lid portion received within said base, and so positioned and shaped that it is adjacent the lower surface of said lid panel when said lid is in the closed position, and extends outwardly to said lid channel means throughout a substantial portion of the periphery of said lid, and
an end portion that is integral with said lid portion and with said base portion.

28. A package structure as claimed in claim 27 wherein said lid panel and said base panel are generally rectangular and two opposed lid channels constitute said channel means, one of said lid channels extending along one of a first pair of opposed edges of said lid panel and inwardly along the other two of the opposed edges, and the other of said lid channels extending along the other of the first pair of opposed edges and inwardly along the other two of the opposed edges.

29. A package structure as claimed in claim 28 wherein the portions of said channels which extend inwardly along the other two of the opposed edges have inner ends spaced from one another, which additionally includes end walls integral with the webs and sidewalls of said channels at their inner ends, and wherein said lid panel extends between the opposed inner ends of said channels and is integral with said end walls.

* * * * *